US007553005B2

(12) United States Patent
Shinada et al.

(10) Patent No.: US 7,553,005 B2
(45) **Date of Patent: *Jun. 30, 2009**

(54) PRINTING APPARATUS AND INK CARTRIDGE THEREFOR

(75) Inventors: Satoshi Shinada, Nagano-ken (JP); Yasuto Sakai, Nagano-ken (JP); Tomio Yokoyama, Nagano-ken (JP); Kazuhiro Hashii, Nagano-ken (JP); Atsuhiko Takeuchi, Nagano-ken (JP); Kazumasa Harada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/469,215

(22) Filed: Aug. 31, 2006

(65) Prior Publication Data

US 2006/0290757 A1 Dec. 28, 2006

Related U.S. Application Data

(63) Continuation of application No. 10/400,107, filed on Mar. 26, 2003, now Pat. No. 7,150,520.

(30) Foreign Application Priority Data

Mar. 29, 2002 (JP) ..... 2002-093838
Apr. 1, 2002 (JP) ..... 2002-099211
Mar. 20, 2003 (JP) ..... 2003-077849

(51) Int. Cl.
*B41J 2/175* (2006.01)
*B41J 2/14* (2006.01)

(52) U.S. Cl. ..... 347/86; 347/49

(58) Field of Classification Search ..... 347/49, 347/86, 87

See application file for complete search history.

(56) References Cited

U.S. PATENT DOCUMENTS 5,617,128 A 4/1997 Thoman et al.
6,036,305 A 3/2000 Nagasaki et al.
6,042,225 A 3/2000 Altendorf et al.
6,089,687 A 7/2000 Helterline
6,116,717 A 9/2000 Anderson et al.

(Continued)

FOREIGN PATENT DOCUMENTS

CN 1189415 A 8/1998
DE 102 37 326 A1 3/2003
EP 0 657 292 A1 6/1995

(Continued)

OTHER PUBLICATIONS

Search Report for European Patent Appln. No. 03 00 6870.4, dated Oct. 15, 2003.

(Continued)

*Primary Examiner*—Anh T. N. Vo
(74) *Attorney, Agent, or Firm*—Stroock & Stroock & Lavan LLP

(57) ABSTRACT

To enable a coupling terminal member of an ink cartridge and a coupling terminal of a printing apparatus to be in certain and increase a degree of freedom on installation position of a coupling terminal member of the cartridge, a cartridge installed in a printing apparatus for supplying the printing apparatus with ink includes an ink cartridge body for containing ink, an ink supply section on which an ink supply opening placed on or near a first sidewall of the ink cartridge body is formed, a memory for storing information on ink in the ink cartridge body, a contact terminal member on a second sidewall of the ink cartridge body coupled to the memory and a positioning member, which protrudes from the second sidewall, for positioning the ink cartridge properly with respect to the printing apparatus when the ink cartridge is installed in the printing apparatus.

9 Claims, 17 Drawing Sheets

U.S. PATENT DOCUMENTS

| | | | | |
|---|---|---|---|---|
| 6,168,262 | B1 | 1/2001 | Clark et al. | |
| 6,170,940 | B1 | 1/2001 | Shinada et al. | |
| 6,220,701 | B1 | 4/2001 | Umemura | |
| 6,227,643 | B1 | 5/2001 | Purcell et al. | |
| 6,276,780 | B1 | 8/2001 | Carrese et al. | |
| 6,302,535 | B1 * | 10/2001 | Sturgeon et al. | 347/86 |
| 6,331,054 | B1 | 12/2001 | Seu et al. | |
| 6,502,917 | B1 * | 1/2003 | Shinada et al. | 347/19 |
| 6,554,412 | B1 | 4/2003 | Seino et al. | |
| 6,796,646 | B2 | 9/2004 | Komplin et al. | |
| 6,863,388 | B2 * | 3/2005 | Seino et al. | 347/86 |
| 7,150,520 | B2 * | 12/2006 | Shinada et al. | 347/86 |
| 2001/0006393 | A1 | 7/2001 | Kline et al. | |
| 2002/0051034 | A1 | 5/2002 | Shinada | |
| 2003/0035024 | A1 | 2/2003 | Chen et al. | |
| 2003/0035033 | A1 | 2/2003 | Chen et al. | |

FOREIGN PATENT DOCUMENTS

| | | | |
|---|---|---|---|
| EP | 0 729 836 | A1 | 9/1996 |
| EP | 0 875 379 | A2 | 11/1998 |
| EP | 0 891 865 | A2 | 1/1999 |
| EP | 0 997 297 | A1 | 5/2000 |
| EP | 1 053 878 | A1 | 11/2000 |
| EP | 1 108 548 | A1 | 6/2001 |
| EP | 1 138 502 | A2 | 10/2001 |
| EP | 1 219 440 | A2 | 7/2002 |
| EP | 1 297 961 | A1 | 4/2003 |
| EP | 1 767 371 | A2 | 3/2007 |
| GB | 2316657 | A | 3/1998 |
| GB | 2 343 145 | A | 5/2000 |
| GB | 2354201 | A | 3/2001 |
| GB | 2375080 | A | 11/2002 |
| JP | 61-155129 | U | 9/1986 |
| JP | H6-155758 | A | 6/1994 |
| JP | 06-336008 | A | 12/1994 |
| JP | 07-148936 | A | 6/1995 |
| JP | 11-58765 | A | 3/1999 |
| JP | 2000-033708 | A | 2/2000 |
| JP | 2001-113722 | A | 4/2001 |
| JP | 2001-199082 | A | 7/2001 |
| JP | 2001-212976 | A | 8/2001 |
| JP | 2001-341323 | A | 12/2001 |
| JP | 2002-502335 | A | 1/2002 |
| JP | 2002-059566 | A | 2/2002 |
| RU | 2 135 367 | C1 | 8/1999 |
| WO | 98/31548 | A1 | 7/1998 |
| WO | 98/55325 | A1 | 12/1998 |
| WO | 99/59823 | A1 | 11/1999 |
| WO | 01/54910 | A2 | 8/2001 |
| WO | 02/02337 | A1 | 1/2002 |

OTHER PUBLICATIONS

Examination Report for German Patent Appln. 103 14 194.4-27, dated Aug. 9, 2004, with Engl. transl.

Office Action from Taiwanese Patent Appln. 092016829, dated Sep. 23, 2004, with Engl. transl.

Notification of Reason(s) for Refusal in Japanese Patent Appln. No. 2003-077849, dated Dec. 21, 2004, with Engl. transl.

Official Notification from Russian Patent Office in Appln. 2003108820/12 (Aug. 18, 2005) and letter from Gorodissky & Partners with partial translation of same.

Decision to Grant in Russian Appln. No. 2003108820/12, dated May 31, 2005.

Combined Search and Examination Report, British Patent Appln. No. GB05009065.9, dated Jul. 12, 2005.

* cited by examiner

PRINTING APPARATUS AND INK CARTRIDGE THEREFOR

CROSS-REFERENCE TO RELATED APPLICATION

This application is a continuation of application Ser. No. 10/400,107, filed on Mar. 26, 2003 now U.S. Pat. No. 7,150, 520, the contents of which are incorporated by reference herein.

This patent application claims priority from Japanese patent applications No. 2002-093838 filed on Mar. 29, 2002, No. 2002-099211 filed on Apr. 1, 2002 and No. 2003-077849 filed on Mar. 20, 2003, the contents of which are incorporated herein by reference.

BACKGROUND OF THE INVENTION

1. Field of the Invention

The present invention relates to a printing apparatus including an ink cartridge for supplying the printing apparatus with ink, a carriage on and from which the ink cartridge is installed and detached and a print head mounted on the carriage. More particularly, the present invention relates to an ink cartridge precisely installed on a printing apparatus for supplying the printing apparatus with ink.

2. Description of the Related Art

Generally, an ink-jet printer, one of the printing apparatus, prints texts or images by ejecting ink droplets onto print media by a print head mounted on a carriage moving back and forth in direction of a horizontal scanning, while a paper feeder supplies the print media, such as papers, set in a paper feeding tray one at a time, and a paper carriage mechanism intermittently sends the print media in direction of a vertical scanning a predetermined quantity at a time. Usually, an ink cartridge containing black ink and an ink cartridge containing ink of various colors, such as yellow, cyan and magenta etc. are separately installed in a carriage of a full-colored ink-jet printer.

The carriage is made up to be divided into a head-mounted unit, on which the print head is mounted, and a cartridge mounting section, in which the ink cartridge is installed, in order to enhance maintenance efficiency of the print head. Further, a memory for storing information about a production date, a product number, the quantity of ink remained etc. is installed on the ink cartridge and a circuit board, which is coupled to the memory with a connecter and coupled to the print head, is placed in the head-mounted unit of the carriage. The circuit board is designed to transmit and receive the information about ink etc. to and from the printing apparatus. As an example of the memory for storing the information, there is a contact type memory unit including a coupling terminal member, which includes a coupling terminal exposed to the outside and a memory unit, which is electrically coupled to the coupling terminal. The coupling terminal is electrically coupled to a coupling terminal of the printing apparatus. The memory unit stores the information about ink etc.

The above usual ink-jet printer has a problem that it may be damaged in case of maintenance handling of the print head, because the circuit board is placed in the head-mounted unit of the carriage.

In addition, transmitting and receiving the information cannot be properly done, unless the coupling terminal member of the memory unit of the ink cartridge certainly contacts to the coupling terminal of the print head. Particularly, when a plurality of the coupling terminal with a small coupling terminal area is closely arranged, the coupling terminal member needs to be very exactly coupled to the coupling terminal of the printing apparatus.

SUMMARY OF THE INVENTION

Therefore, it is an object of the present invention to provide a printing apparatus for protecting a board in which a device for reading and writing information about ink of an ink cartridge is installed during maintenance work on a print head, which is capable of overcoming the above drawbacks accompanying the conventional art.

It is another object of the present invention to provide an ink cartridge enabling a coupling terminal member of a memory of the ink cartridge and a coupling terminal of the printing apparatus to be in certain contact with each other, which is capable of overcoming the above drawbacks accompanying the conventional art.

It is another object of the present invention to provide an ink cartridge having a degree of freedom on installation position of a coupling terminal member of an ink cartridge and a coupling terminal of a printing apparatus, which is capable of overcoming the above drawbacks accompanying the conventional art.

The above and other objects can be achieved by combinations described in the independent claims. The dependent claims define further advantageous and exemplary combinations of the present invention.

According to the first aspect of the present invention, an ink cartridge installed in a printing apparatus for supplying the printing apparatus with ink includes an ink cartridge body for containing ink therein and including a first and a second sidewalls, the second sidewalls opposite to the first sidewall, an ink supply section on which an ink supply opening placed on or near the first sidewall of the ink cartridge body is formed, a memory for storing information on ink contained in the ink cartridge body, a contact terminal member placed on the second sidewall of the ink cartridge body and coupled to the memory and a positioning member, which protrudes from the second sidewall of the ink cartridge body, for deciding position of the ink cartridge with respect to the printing apparatus when the ink cartridge is installed in the printing apparatus.

With respect to the ink cartridge, the ink supply opening may be provided to be close to the first sidewall of the ink cartridge body on a bottom crossing the first and second sidewalls.

With respect to the ink cartridge, the positioning member may include a positioning rib protruding in a direction toward the bottom of the cartridge body.

The ink cartridge may further include a projecting part provided over the contact terminal member of the memory and the positioning rib.

With respect to the ink cartridge, the projecting part may include a surface which protrudes over the positioning rib and substantially parallel to the second sidewall.

With respect to the ink cartridge, the positioning rib may be provided to a place outside of an area defined by vertically extending lines along a left and right side edges of the contact terminal member.

With respect to the ink cartridge, the contact terminal member is placed to be close to a sidewall positioned next to another ink cartridge when at least two ink cartridges are installed in the printing apparatus.

The ink cartridge may further include an inverse mounting preventing rib for being engaged with the carriage of the printing apparatus when the ink cartridge is installed in a proper orientation on the printing apparatus.

The ink cartridge may further include an inverse mounting preventing rib which is engaged with the printing apparatus when the ink cartridge is installed in a proper orientation on the printing apparatus.

The ink cartridge may further include an inverse mounting preventing rib formed on a first side wall facing a second side wall, both said first and said second side walls intersecting the bottom and the front walls, said second side wall being located next to another ink cartridge when at least two ink cartridges are installed in the printing apparatus, whereas the contact terminal member is located near the second side wall.

According to the second aspect of the present invention, an ink cartridge installed in a printing apparatus for supplying the printing apparatus with ink includes an ink cartridge body for containing different ink including a first sidewall, a second sidewall opposite to the first sidewall, partitioning walls placed in the ink cartridge body and a plurality of ink chamber separated by the partitioning walls, an ink supply section on which ink supply openings placed on or near the first sidewall of the ink cartridge body corresponding to the a plurality of ink chamber are formed, an memory for storing information on ink contained in the ink cartridge body and a contact terminal member coupled to the memory and placed to corresponds to the partitioning walls on the second wall of the ink cartridge body.

With respect to the ink cartridge, the ink supply openings may be placed to be close to the first sidewall of the ink cartridge body on the bottom crossing the first and the second sidewall.

With respect to the ink cartridge, the contact terminal member may be placed at a place corresponding to the partitioning walls close to a sidewall positioned next to another ink cartridge when at least two ink cartridges are installed in the printing apparatus.

The ink cartridge may further include an inverse mounting preventing rib for being engaged with the printing apparatus when the ink cartridge is installed in a proper orientation on the printing apparatus.

The ink cartridge may further include an inverse mounting preventing rib for being engaged with the printing apparatus when the ink cartridge is installed in a proper orientation on the printing apparatus.

The ink cartridge may further include an inverse mounting preventing rib, which is placed on a sidewall facing a crossing sidewall, which crosses the bottom and the second sidewall, wherein the contact terminal member is placed to be close to the crossing sidewall, for being engaged with the printing apparatus when the ink cartridge is installed in a proper orientation on the printing apparatus.

With respect to the ink cartridge, a center of the contact terminal member may be placed at a place from which a center axis of the ink supply openings is away.

According to the third aspect of the present invention, a printing apparatus includes a head-mounted unit on which a print head is mounted and a carriage including a cartridge mounting section in which an ink cartridge is installed, wherein a board including a device for reading and writing information on ink of the ink cartridge is placed in the cartridge mounting section. Consequently, although the head-mounted unit is removed from the apparatus body during maintenance work on the print head, the board including the device for reading and writing information about ink of the ink cartridge is protected because the board can remains in the apparatus body.

According to the fourth aspect of the present invention, a printing apparatus includes a carriage in and from which an ink cartridge is installed and uninstalled and a print head mounted on the carriage, wherein a board including a device for reading and writing information about ink of the ink cartridge is placed on an inside of a front wall of the carriage. Consequently, the board including the device for reading and writing information about ink of the ink cartridge is protected because the board can be away from the print head placed at the back of the carriage.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiments are not necessarily essential to the invention.

Figure 1:
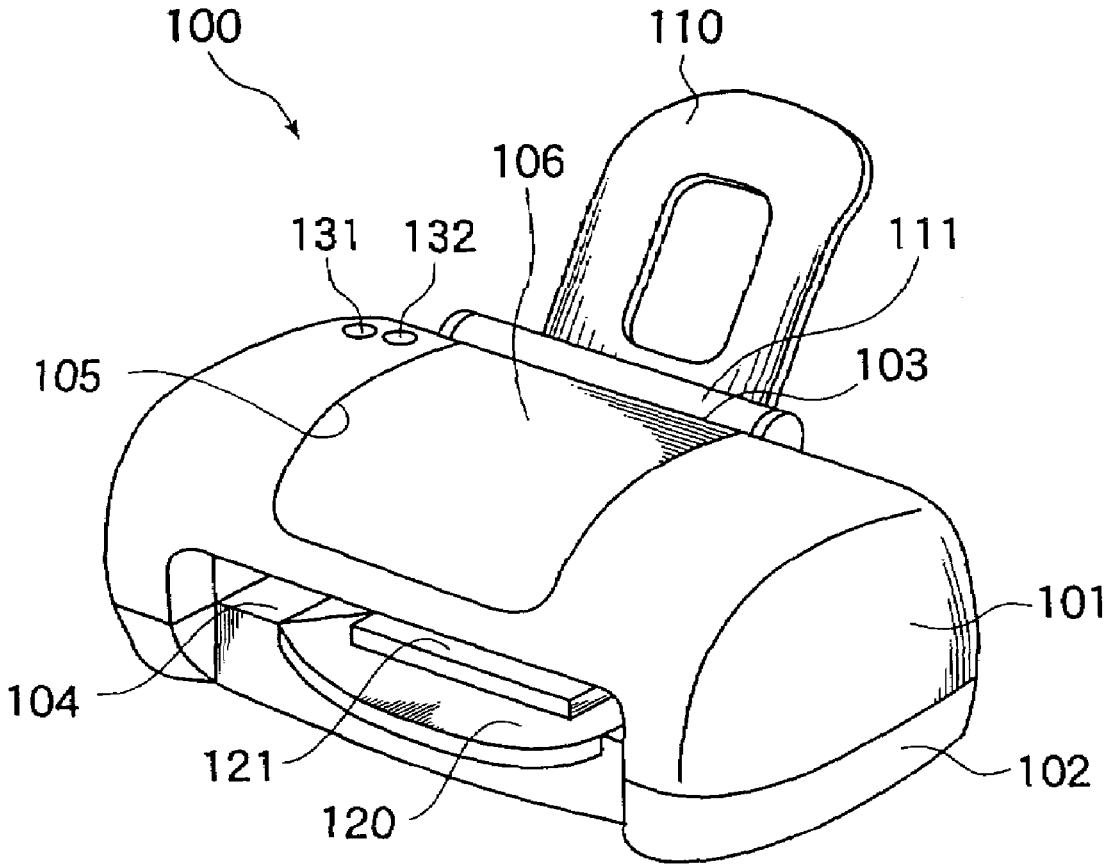
FIG. 1 is a perspective view showing an overall external structure of an ink-jet printer, one of the printing apparatus, with respect to an embodiment of the present invention.

FIG. 1 is a perspective view showing an overall external structure of an ink-jet printer, one of the printing apparatus, with respect to an embodiment of the present invention. The ink-jet printer 100, which is hexahedron-shaped and extends in the widthwise direction, includes an upper housing and a lower housing. The upper housing and the lower housing are combined with snap fits.

At the back of the upper housing 101, a paper feed entry 103 is formed. In the paper feed entry 103, a paper feed tray 110 on which papers fed are stacked up, and a paper feed guide 111, with which the papers are in order, located at one end of the paper feed tray 110, are placed. The paper feed tray 110 is placed to tilt from the paper feed guide 111 toward upper direction so that the paper feed tray 110 keeps the papers sloping.

At the front of the upper housing 101, a paper discharge opening 104 is formed. In the paper discharge opening 104, a paper discharge stacker 120, on which the papers ejected are piled up, is placed. The paper discharge stacker 120 is placed to store the papers on the back of the lower housing 102 from the paper discharge opening 104 in use and provide papers sloping from the paper discharge opening 104 out of use so that the papers are received in the sloping state.

In addition, the paper discharge opening 104 includes a stacker holding unit 121 for holding the paper discharge stacker 120 at the opposite end to the paper ejection side along the widthwise direction, when the paper discharge stacker 120 is pulled out. Moreover, FIG. 1 shows the state that the paper discharge stacker 120 is in the internal side of the lower housing 102.

All over the surface of the upper housing 101, a window 105 is formed. The window 105 is covered with a transparent or semitransparent cover 106, which slightly curves, capable of being opened and closed. With opening the cover 106, exchanging the ink cartridge or maintenance work can be easily done. And, on the left back of the upper housing 101, a power switch 131 and an operation switch 132, each of which is a button type, are placed.

Figure 2:
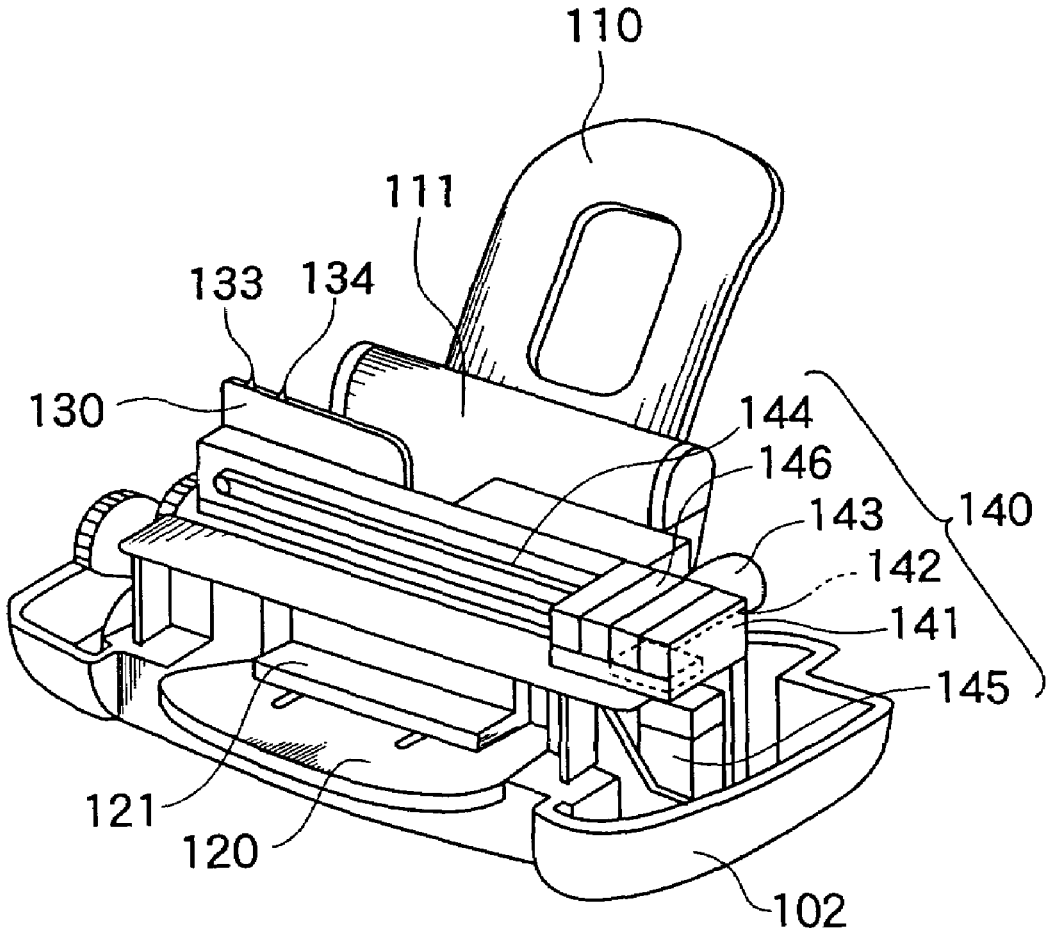
FIG. 2 is a perspective view showing an overall internal structure of the ink-jet printer shown in FIG. 1 from which the upper housing is removed.
Figure 3:
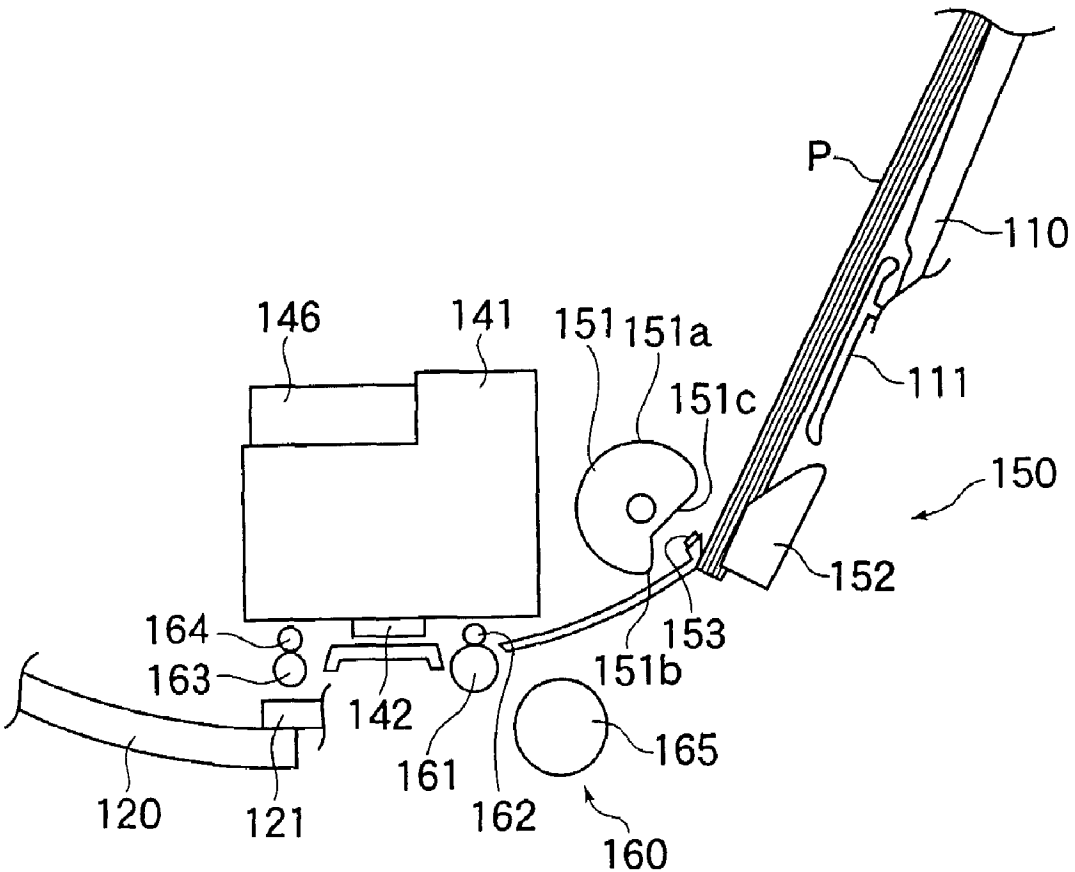
FIG. 3 is a cross-sectional view of main units of the ink-jet printer shown in FIG. 2.

FIG. 2 is a perspective view showing an overall internal structure of the ink-jet printer 100 shown in FIG. 1, from which the upper housing 101 is removed, and FIG. 3 is a cross-sectional view of main units thereof. In the lower housing 102, a main board 130, of which a printer controller is composed, shown in FIG. 2, is vertically placed, and a printing mechanism 140, shown in FIG. 2, a paper feed mechanism 150 and a paper feed mechanism 160, shown in FIG. 3, of which a print engine is compose, is placed.

On the main board 130, control devices, memory devices or/and other various circuit devices, such as CPU, ROM, RAM and ASIC etc., not shown in drawings, are installed, and light emitting diodes 133, 134 with which a user can check if the power switch 131 or the operation switch 132 is properly operated when the user pushes the switches, are placed at the edge of the main board 130.

The printing mechanism 140 includes a carriage 141, a print head 142, a carriage motor 143, a timing belt 144, a suction pump 145 and a detection unit 2 etc. On papers carried by a paper feed mechanism 160, the print head 142, mounted on the carriage 141, prints an image by scanning by the timing belt 144 driven by the carriage motor 143. This print head 142 is supplied with ink by the ink cartridge 146, installed in the carriage 141, and the colors of the ink may be, for example, yellow, magenta, cyan and black.

The paper feed mechanism 150 includes a paper feed tray 110, a paper feed guide 111, a paper feed roller 151, a hopper 152 and a separation pad etc. Papers P piled up on the paper tray 110 and put in order by the paper guide 111 are pressed to be on the separation pad 153 by the raised hopper 152 according to rotation of the paper feed roller 151, so that the paper P are fed into the paper feed mechanism 160 a piece at a time from the top of the papers P.

The paper feed mechanism 160 includes a paper feed roller 161, a driven roller 162, a paper discharge roller 163, a jagged roller 164, a paper feed motor 165 and a paper discharge stacker 120 etc. The paper P fed by the paper feed mechanism 150 is inserted within the paper feed roller 161 and the driven roller 162 driven by the paper feed motor 165 and conveyed to the printing mechanism 140. Next, the paper P is inserted within the paper discharge roller 163 and the jagged roller 164 driven by the paper feed motor 165, and conveyed to the paper discharge stacker 120.

Figure 4:
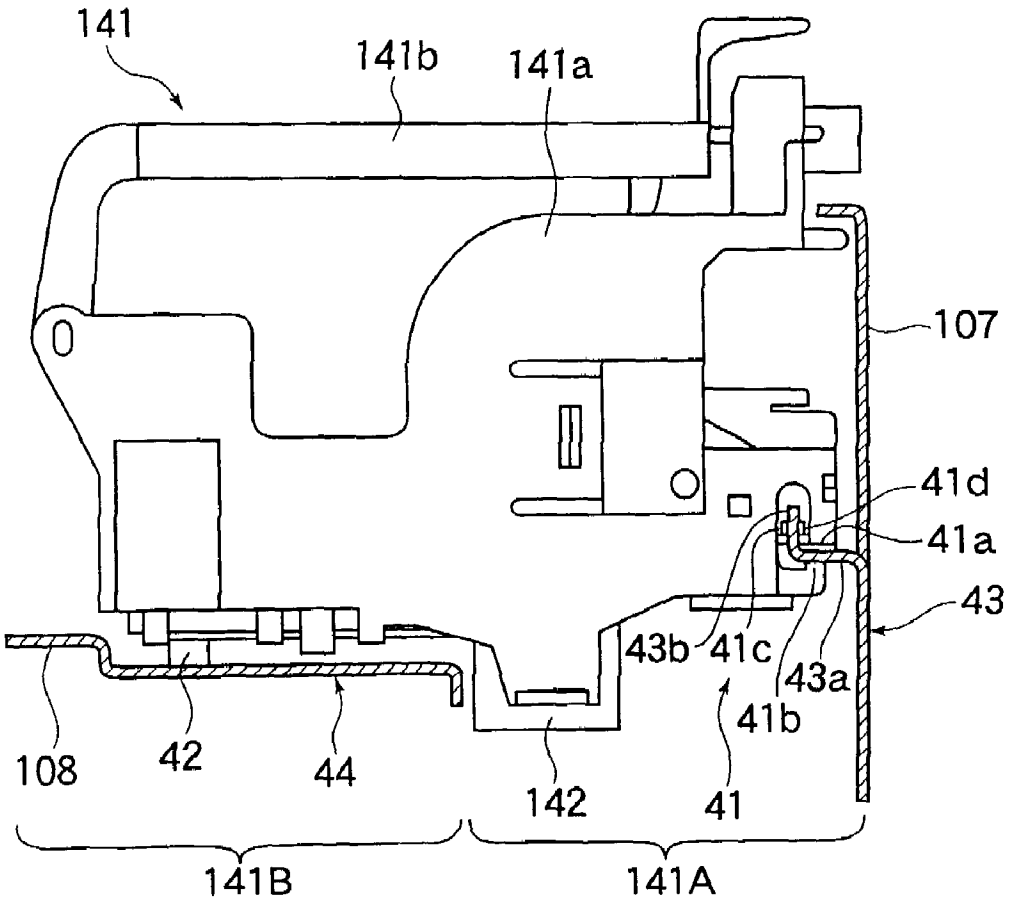
FIG. 4 is a side view of the carriage of the ink-jet printer shown in FIG. 1.
Figure 5:
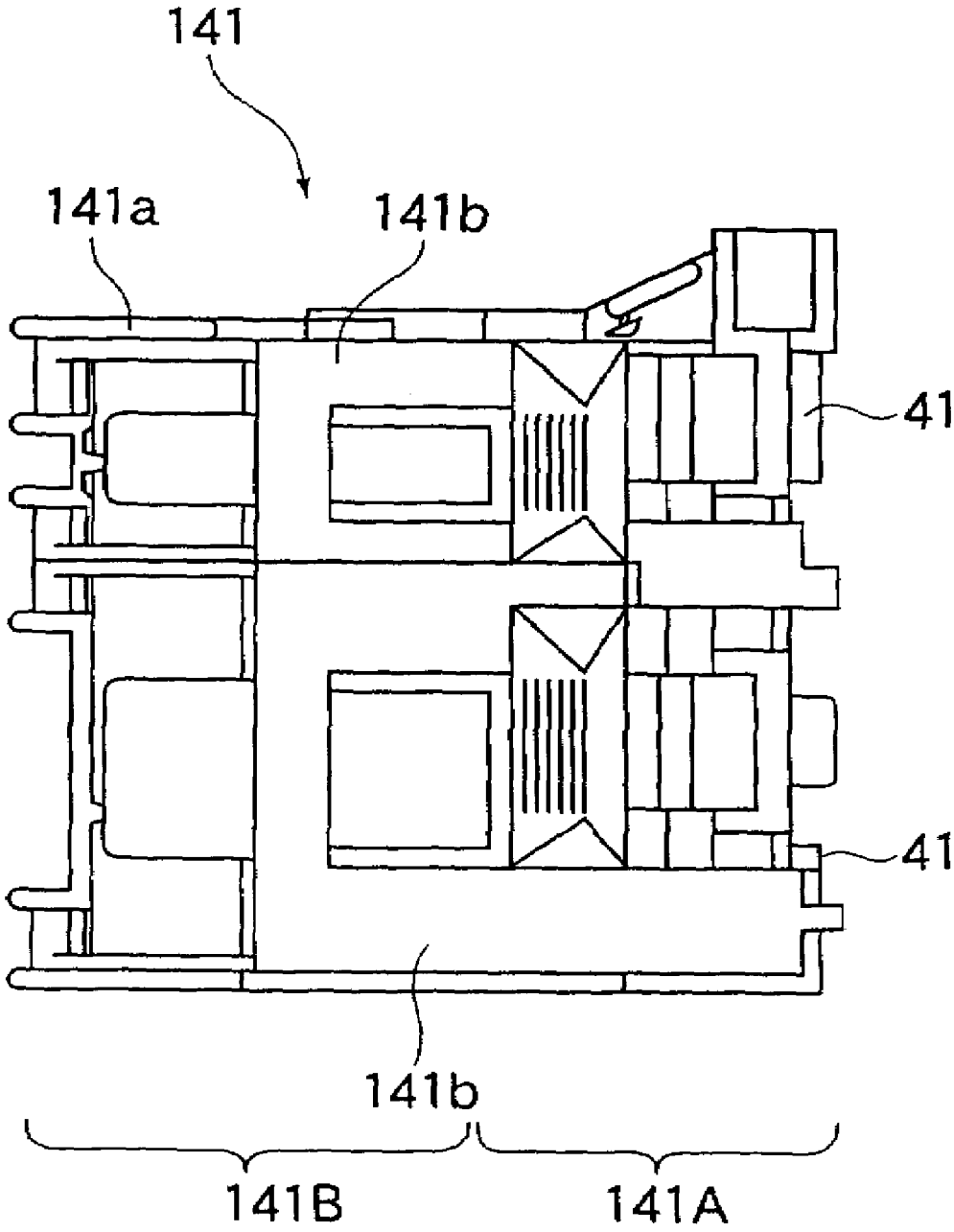
FIG. 5 is a top view of the carriage shown in FIG. 4.
Figure 6:
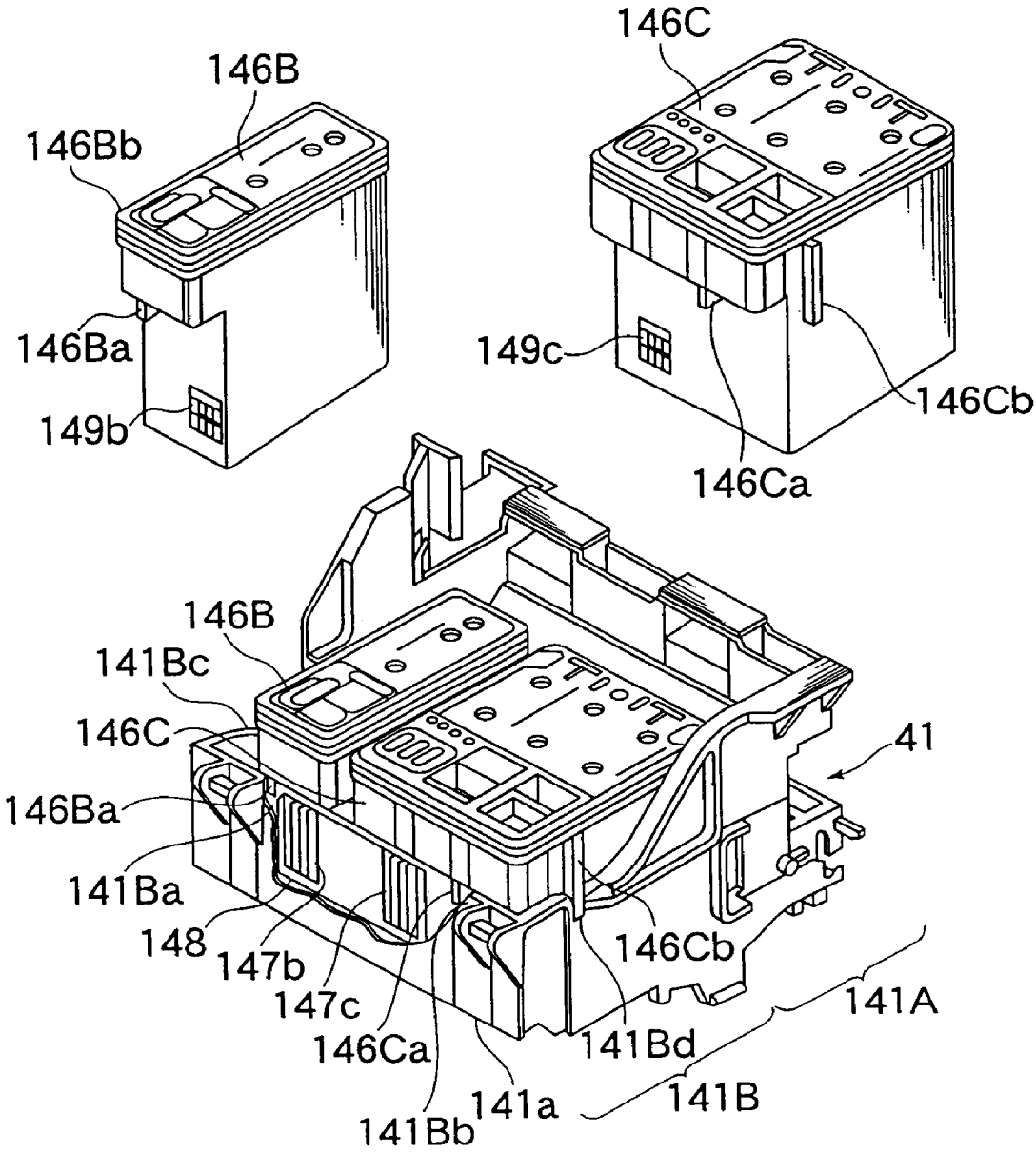
FIG. 6 is a perspective view of the carriage partly removed shown in FIG. 4.

FIG. 4 to FIG. 6 are a side view, a top view and a perspective and partly exploded view of the carriage 141, respectively. The carriage 141 includes a body 141*a* and a cover 141*b* (FIGS. 4 and 5). The print head 142 is mounted on the bottom of the body 141*a* of the carriage 141 (FIG. 4,5), and the ink cartridge 146B containing black ink and the ink cartridge 146C containing ink of various colors, such as yellow, cyan and magenta etc., are installed in the inside of the body 141*a* of the carriage 141 (FIG. 6).

And, carriage guide section 41 separated each other at a predetermined distance, are wholly formed at both sides of the back of the body 141*a* of the carriage 141 (FIG. 4,5). And, a guide member 43 (FIG. 4) sliding with being enfolded by the carriage guide section 41 is formed in a mainframe 107 (FIG. 4) placed to be a vertical state and perpendicular to a direction of conveying the paper. This guide member 43 is placed like the main frame 107 and is bent so that the cross-section of the end of the guide member 43 is Z-shaped. Further, in a bent area of the guide member 43, a pair of projection 41*a*, 41*b* holding a horizontal part 43*a* of the guide member 43 and a pair of projection 41*c*, 41*d* holding a vertical part 43*b* of the guide member 43 are formed at the carriage guide section 41. In addition, a slide unit 42 is wholly formed at the mid-front of the bottom of the body 141*a* of the carriage 141. The guide section 44 (FIG. 4) on which the slide unit 42 slides is formed at a paper ejection frame 108 placed to be a horizontal state and perpendicular to a direction of conveying the paper.

As usual, the carriage 141 is made up to be divided into a head-mounted unit 141A, on which the print head is mounted, and a cartridge mounting section 141B, in which the ink cartridges 146B and 146C are installed, in order to enhance a maintenance efficiency of the print head 142. A circuit board 148 (FIG. 6) including connectors 147*b* and 147*c* (FIG. 6) is set on the inside of the wall of the front of the cartridge mounting section 141B.

The circuit board 148 is coupled to memories 149*b* and 149*c* (FIG. 6) installed for storing information about a production date, a product number, the quantity of ink remained etc. on the front of the ink cartridges 146B and 146C, which includes a connector, with the connector 147*b* and 147*c*. In addition, a board coupled to the print head 142 is placed to be separated from the circuit board 148 on the inside wall of the back of the head-mounted unit 141A.

According to the above structure, the print head 142 is mounted on the head-mounted unit 141A and the circuit board 148 is placed in the cartridge mounting section 141B so that the circuit board 148 can be protected during maintenance work of the print head 142 because the circuit board 148 and the print head 142 are separated.

Positioning ribs 146Ba and 146Ca for deciding the position when the memories 149*b* and 149*c* including connectors and the connector 147*b* and 147*c* of the circuit board 148 are coupled are formed on the front of the ink cartridges 146B and 146C. That is, the positioning ribs 146Ba and 146Ca decide the position of the memories 149*b* and 149*c* including connectors and the connector 147*b* and 147*c* of the circuit board 148, when the ink cartridges 146B and 146C are installed in the cartridge mounting section 141B of the carriage 141 by being engaged with grooves 141Ba and 141Bb placed on the front of the cartridge mounting section 141B.

And, error mounting preventing ribs 146Bb and 146Cb are formed to prevent the ink cartridge 146B and 146C from being installed in other kinds of the carriage on the sides of the ink cartridge 146B and 146C. That is, when the ink cartridges 146B and 146C are installed in the cartridge mounting section 141B of the carriage 141, the error mounting is protected because the cover 141*b* is closed properly if the error mounting preventing ribs 146Bb and 146Cb engaged with grooves 141Bc and 141Bd placed on the sides of the cartridge mounting section 141B, but the ink cartridges 146B and 146C cannot be installed properly in other kinds of the carriage by collision.

Figure 7:
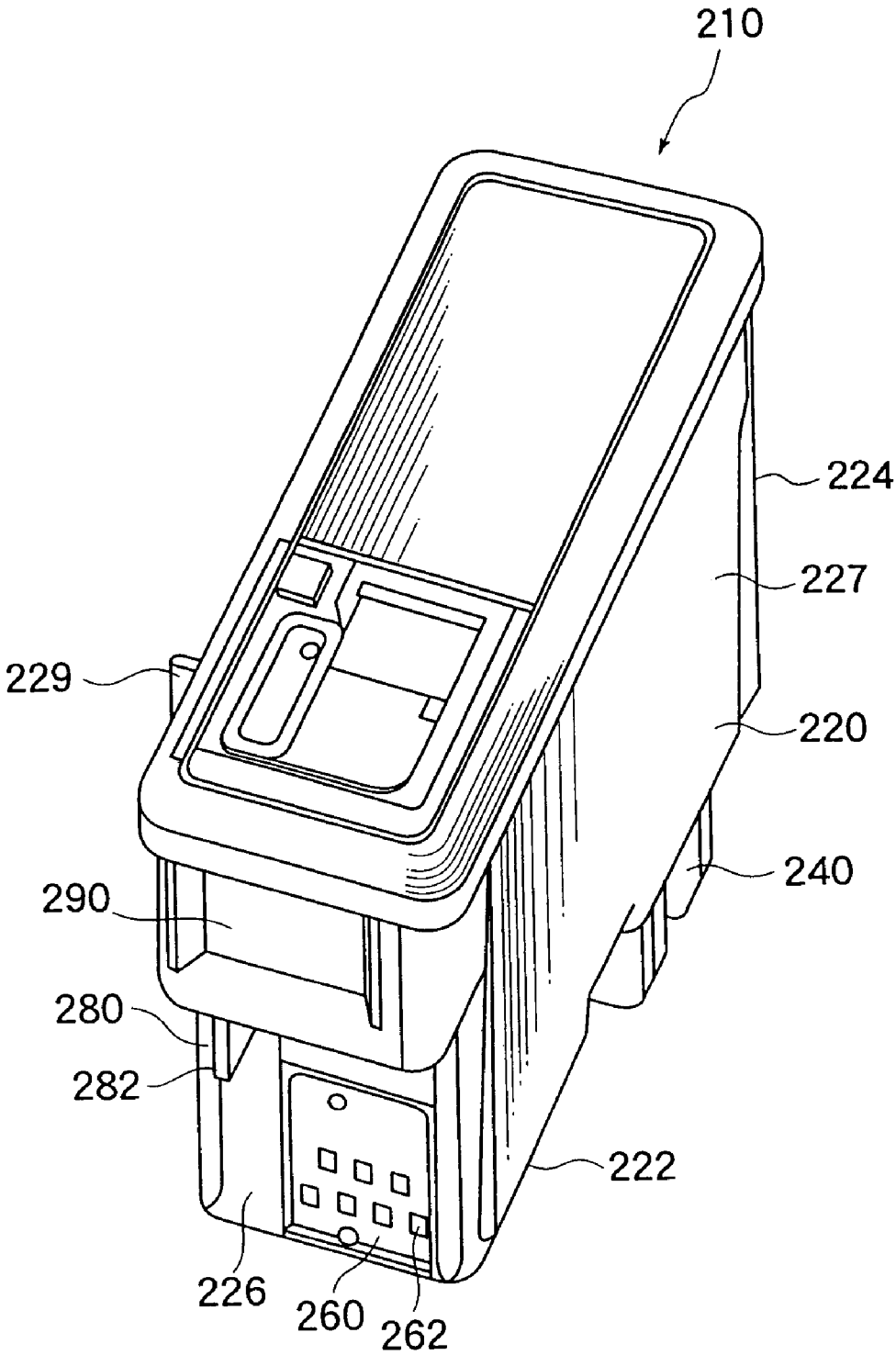
FIG. 7 is a perspective view of an ink cartridge, one of the embodiments of the present invention.
Figure 8:
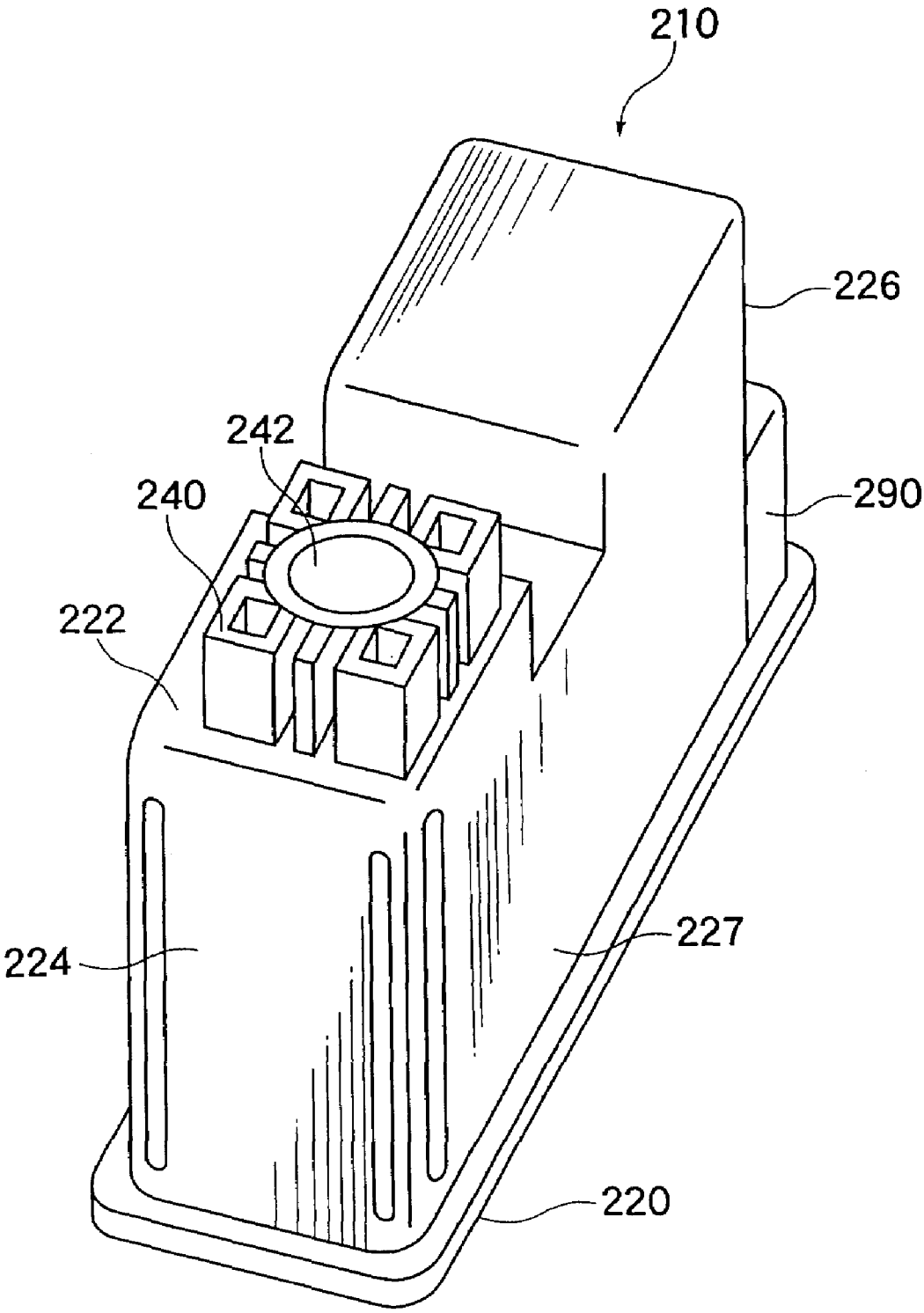
FIG. 8 is a perspective view showing the bottom of the ink cartridge.

FIG. 7 is a perspective view of an ink cartridge, one of the embodiments of the present invention. And, FIG. 8 is a perspective view showing the bottom of the ink cartridge shown in FIG. 7. The ink cartridge 210 includes an ink cartridge body 220, an ink supply section 240, a memory 260 and a positioning member 280.

The ink cartridge body 220 contains ink, for example black ink, thereof. As one of the examples of the ink cartridge body 220, a container, which is substantially rectangular in cross section, is filled with a porous material holding ink. However, the present invention is not limited to this embodiment, so for example, a hollow container may directly contain ink and selectively supply ink to a printing apparatus by an open and close means, such as a valve and the like, in the ink supply section.

The ink supply section 240 has an ink supply opening 242, placed on the bottom 222 of the ink cartridge body 220. The ink supply opening 242 is placed to be close to the first wall 224 crossing the bottom 222 of the ink cartridge body 220. Here, the bottom 222 of the ink cartridge body 220 is defined as the surface, on which the ink supply section 240 is placed, and the bottom is not always towards a lower position in use of the ink cartridge.

The memory 260 has a memory device storing information about ink, such as the kind of ink cartridge, the kind of ink, the ink cartridge contains, the color of ink and the current quantity of ink etc. As an example of the memory 26, there is a contact type IC chip. The contact type IC chip has a board, a contact terminal member including contact terminals exposed on the surface of the board and a memory device placed on the back of the board so that the information data of the memory device is read or written as the contact terminals and the exterior are in contact and are electrically coupled.

According to the present embodiment, the memory 260 is a contact type and has a contact terminal member 262 including seven contact terminals exposed to the exterior. The contact terminal member 262 is placed on the second sidewall 226, which is opposite to the first sidewall 224 and crosses the bottom 222 of the ink cartridge body 220. Here, the number of the contact terminals of the contact terminal member is not limited to seven. It may be a possible construction that the contact terminal member 262 is placed alone on the second sidewall 226, while the memory device of the memory 260 is placed on the suitable position of the ink cartridge body 220, such as other sidewall of the ink cartridge body 220 so that the contact terminal member 262 and the memory of the memory is electrically coupled by, for example, a flexible print circuit (FPC). And, not limited to a contact type, the terminal member may be none contact type, using magnetism or optics.

Figure 9A:
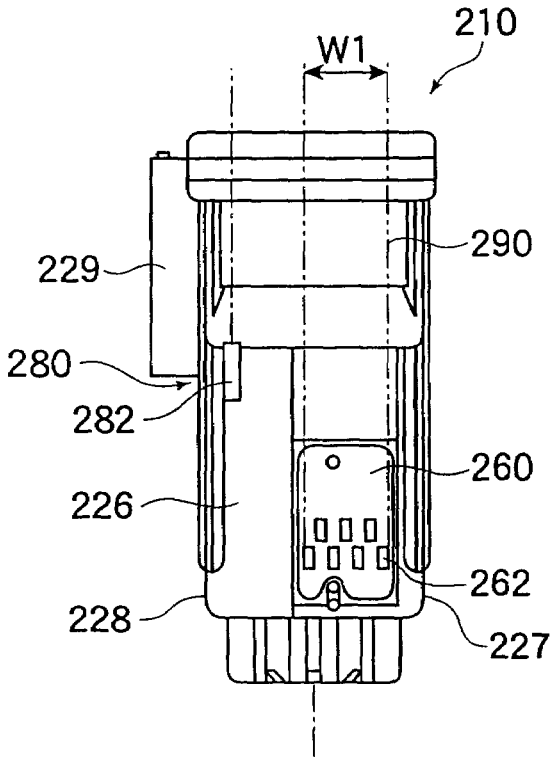
FIG. 9A is a side view showing the second sidewall of the ink cartridge.
Figure 9B:
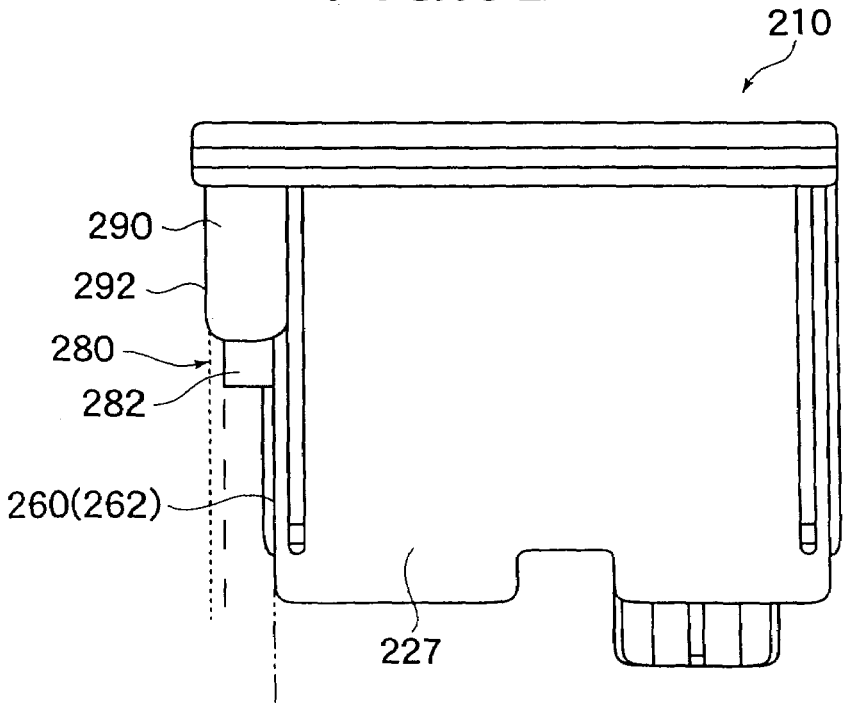
FIG. 9B is a side view showing the third sidewall of the ink cartridge.

FIG. 9A is a side view showing the second sidewall 226 of the ink cartridge 210 according to the embodiment of the present invention. FIG. 9B is a side view showing the third sidewall 227 of the ink cartridge 210. A positioning member 280 is placed for enabling the ink cartridge 210 to be properly installed in the printing apparatus on the second sidewall 226. The positioning member 280 has a positioning rib 282, which protrudes from the second sidewall 226 and is extended towards the bottom 222. As shown in FIG. 9A, the positioning rib 282 is located out of the range of the width W1 of the contact terminal member 262. That is, the centerline (the single-dotted and dashed line) of the positioning rib 282 is in the outside of the width W1 (the distance between the dashed lines) of the contact terminal member 262.

The ink cartridge 210 further includes a projecting part 290 more closely placed to the top of the ink cartridge 210 than the contact terminal member 262 of the memory 260 and the positioning rib 282 is. The projecting part 290 has a surface 292, which protrudes above the positioning rib 282 and is nearly parallel to the second sidewall 226. That is, referring to FIG. 9B, the position (the broken line) of the surface 292 of the projecting part 290 is beyond either the position (the dotted and dashed line) of the positioning rib 282 or the position (the double-dotted and dashed lines) of the contact terminal member 262. Consequently, in the case of being handled the ink cartridge by a user, the projecting part 290 is in contact with the exterior so that the contact terminal member 262 and the positioning rib 282 can be protected from an impact of the exterior. Especially, even though a user drops the ink cartridge 210 onto the floor by mistake, the contact terminal member 262 is safe because the contact terminal member 262 is not in contact with the floor.

As shown in FIG. 9A, the center of the contact terminal member 262, that is, the lengthwise center axis of the middle one of the contact terminals in the upper row, is placed at a different position from the center axis (the double-dotted and dashed line) of the ink supply opening 242. The contact terminal member 262 is placed to be close to the third sidewall 227 crossing both the second sidewall 226 and the bottom 222 on the second sidewall 226. In addition, the ink cartridge 210 further includes an inverse mounting preventing rib 229 placed on the fourth sidewall 228 opposite to the third sidewall 227.

Figure 10:
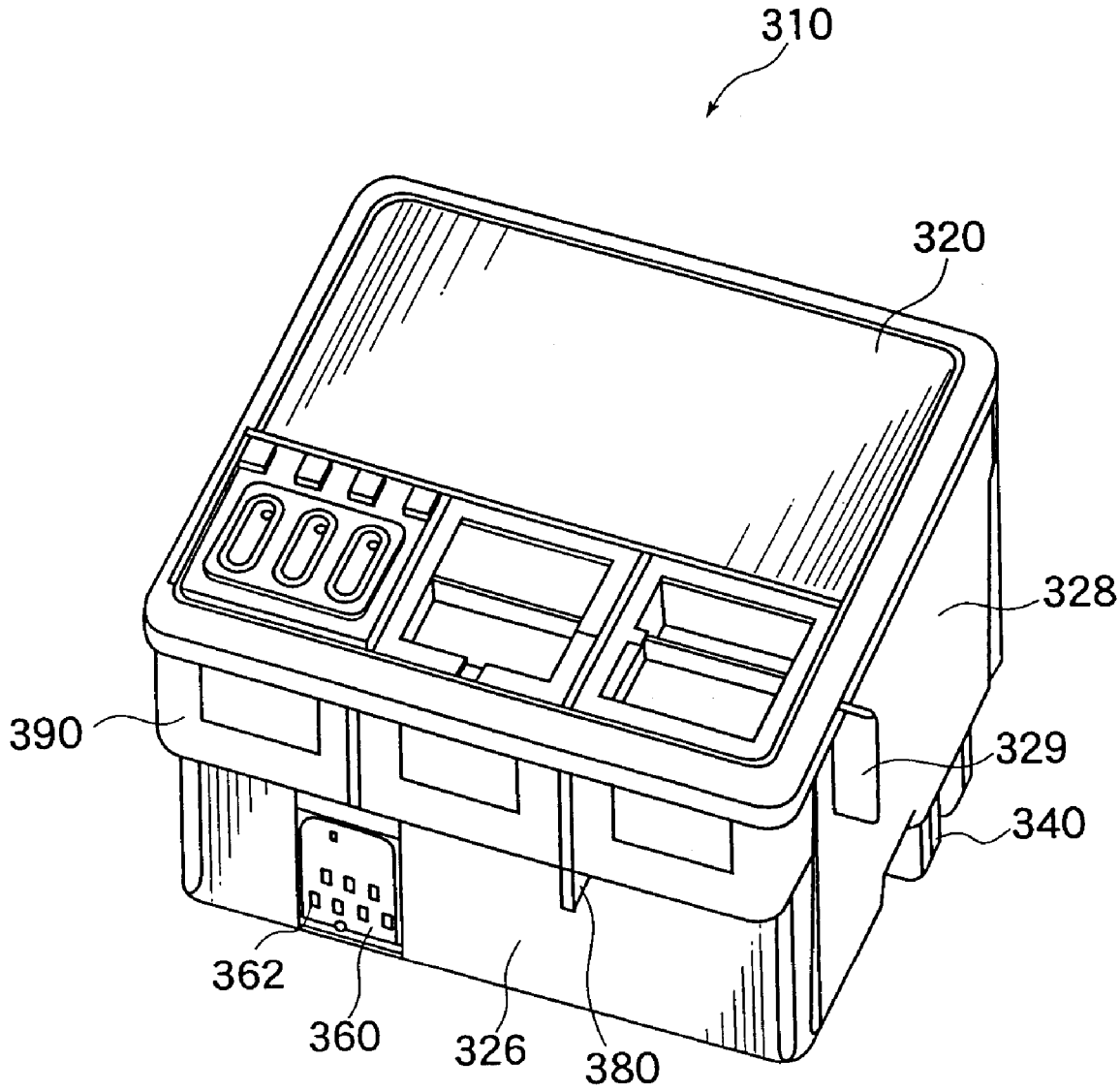
FIG. 10 is a perspective view of an ink cartridge, another embodiment of the present invention.
Figure 11:
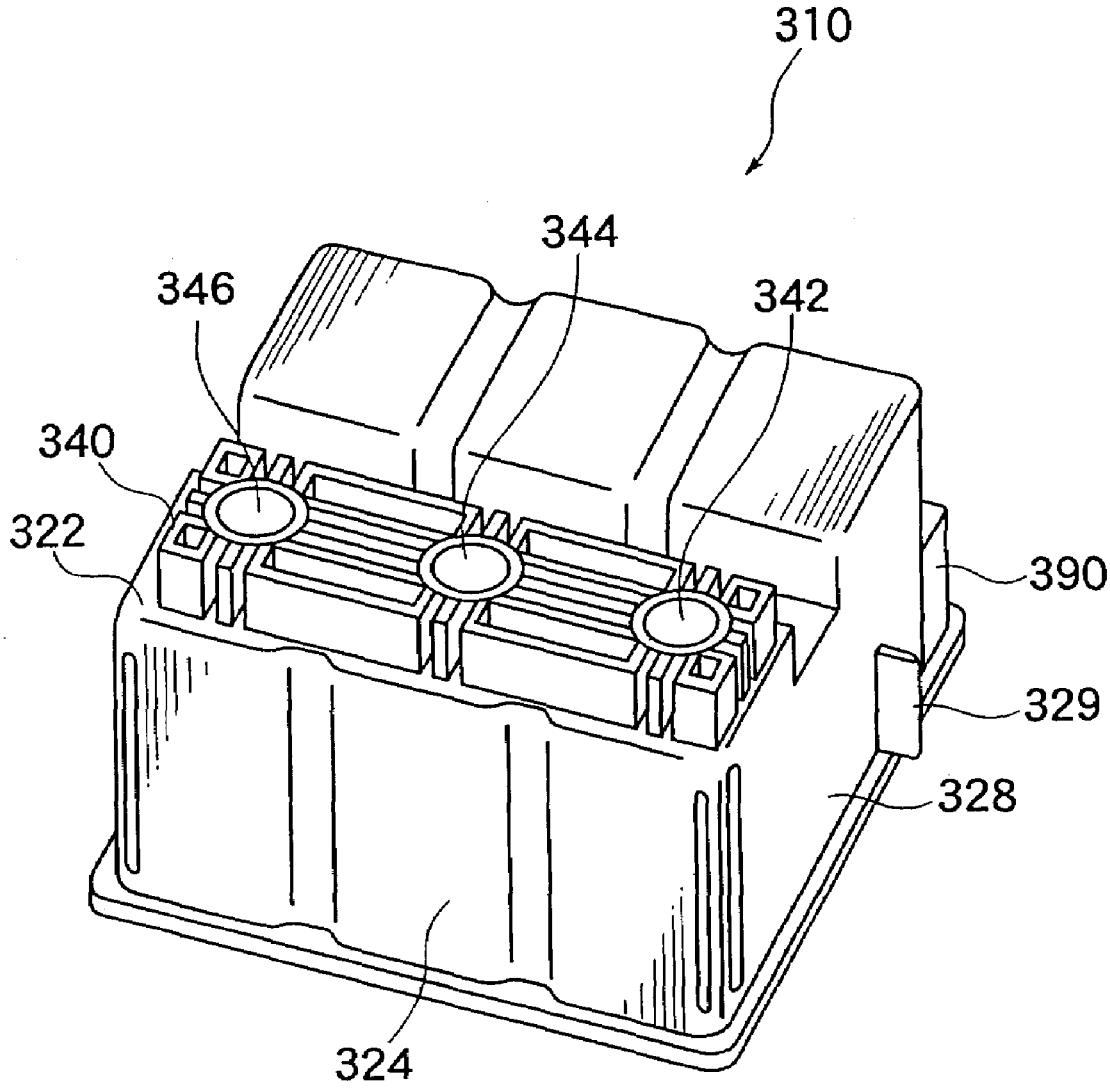
FIG. 11 is a perspective view showing the bottom of the ink cartridge shown in FIG. 10.

FIG. 10 is a perspective view of an ink cartridge, another embodiment of the present invention, and FIG. 11 is a perspective view showing the bottom of the ink cartridge shown in FIG. 10. The ink cartridge 310 includes an ink cartridge body 320, an ink supply section 340, a memory 360 and a positioning member 380.

Figure 12:
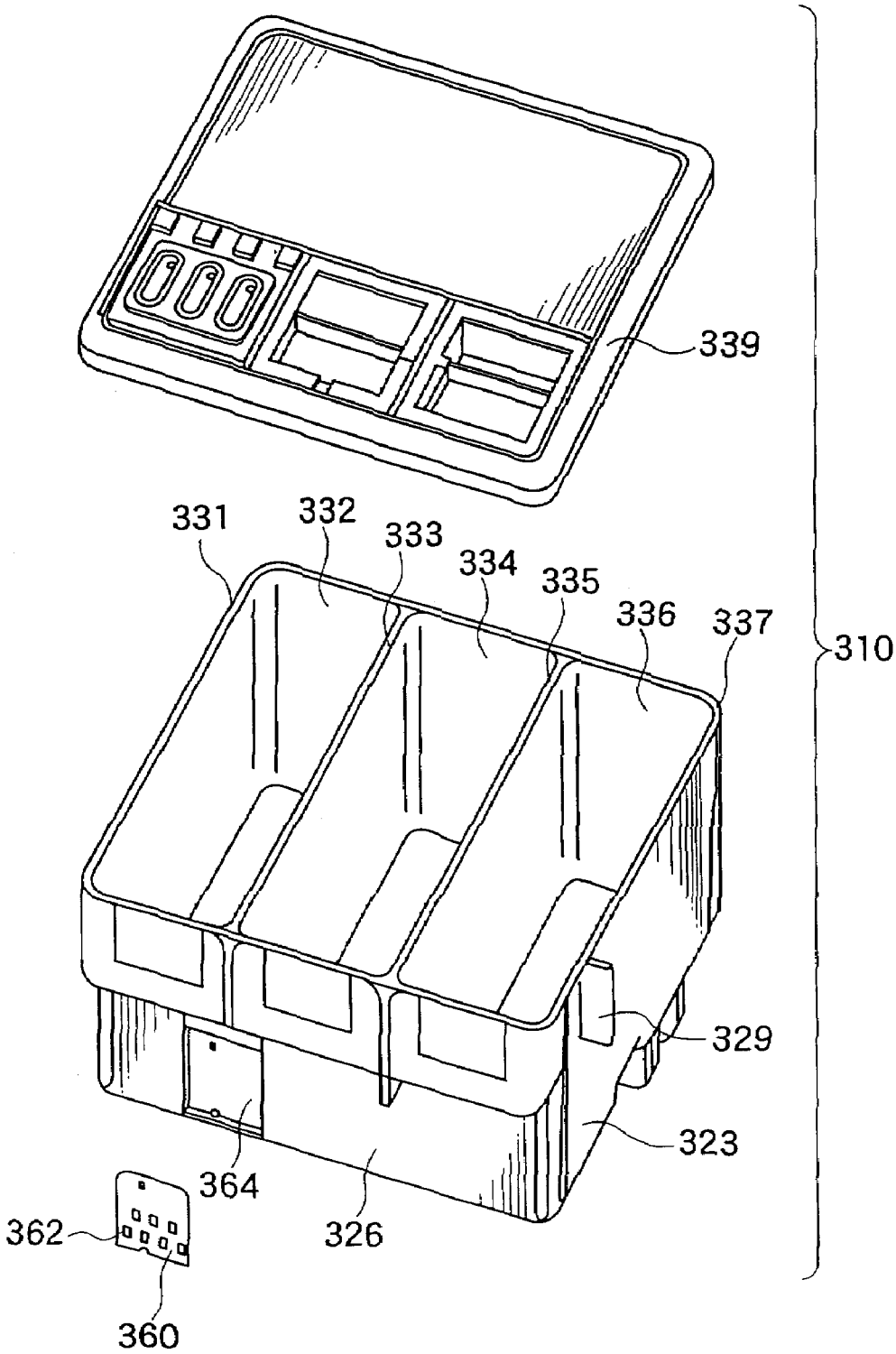
FIG. 12 is a perspective exploded view of the ink cartridge shown in FIG. 10.

FIG. 12 is a perspective and exploded view of the ink cartridge 310. The ink cartridge body 320 has partitioning walls 333 and 335 placed therein. In addition, the ink cartridge body 320 has a plurality of ink chamber 332, 334 and 336, which are separated by the partitioning walls 333 and 335 and contain different ink. As shown in FIG. 12, the ink cartridge body 320 has 3 ink chambers, the ink chamber 332 made up of an outside wall 331 and the partitioning wall 333, the ink chamber 334 made up of the partitioning wall 333 and the partitioning wall 335 and the ink chamber 336 made up of the partitioning wall 335 and an outside wall 337. For example, cyan ink is contained in the ink chamber 332, magenta ink is contained in the chamber 334 and yellow ink is contained in the chamber 336. Moreover, the ink cartridge body 320 has a whole lid 339 nearly parallel to the bottom 322. In addition, FIG. 12 is a perspective view to describe the partitioning walls and the ink chambers, and other components such as a substance, which has lots of holes, keeping ink etc., are omitted.

The ink supply section 340 has ink supply openings 342, 344 and 346 placed to be close to the first sidewall 324 crossing the bottom 322 of the ink cartridge body 320 on the bottom 322 of the ink cartridge body 320 corresponding to the a plurality of the ink chamber 332, 334 and 336.

The memory 360 has a contact terminal member 362. The contact terminal member 362 is placed on the second sidewall 326 opposite to the first sidewall 324 crossing the bottom 322 of the ink cartridge body 320 and located at the position corresponding to the partitioning wall 333. The memory 360 has the same composition and function as the memory 260 of the ink cartridge 210 does so the description of them is omitted.

Figure 13A:
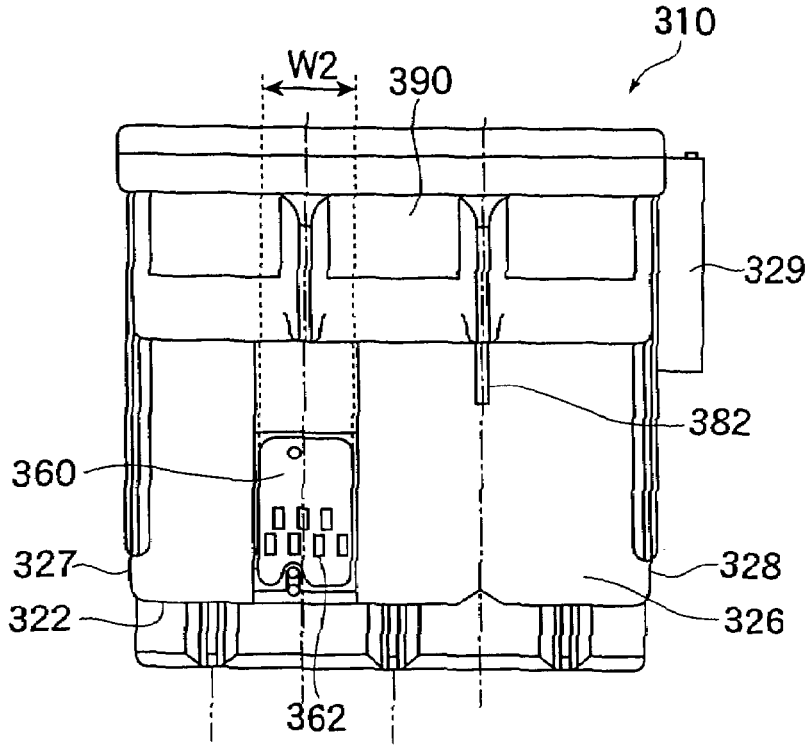
FIG. 13A is a front elevational view showing the second sidewall of the ink cartridge according to the embodiment of the present invention.
Figure 13B:
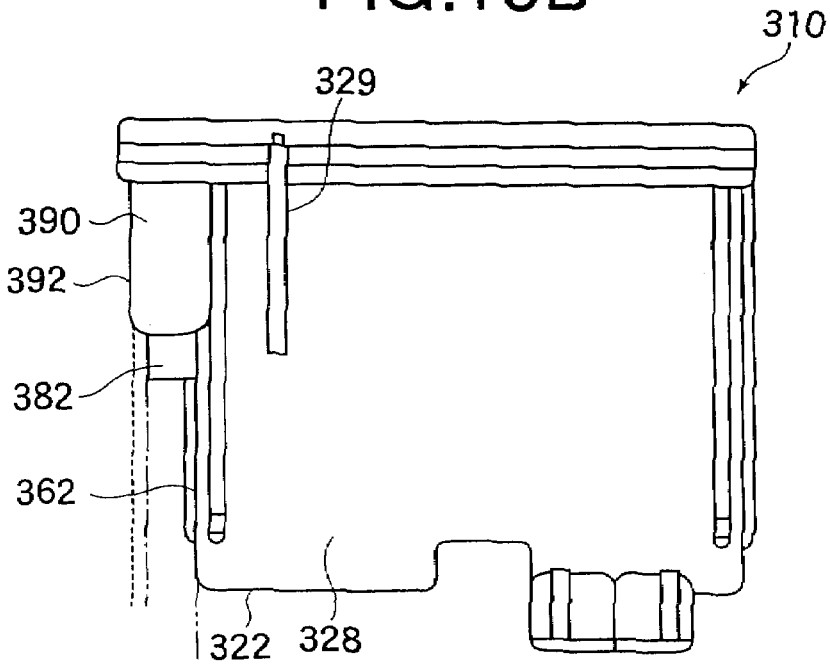
FIG. 13B is a side elevational plan view showing the fourth sidewall of the ink cartridge.

FIG. 13A is a top view showing the second sidewall 326 of the ink cartridge 310 according to the embodiment of the present invention. FIG. 13B is a top view showing the fourth sidewall 328 of the ink cartridge 310.

As shown in FIG. 13A, the center of the contact terminal member 362 is placed at the position different from the center axis (the double-dotted and dashed line) of the ink supply openings. The contact terminal member 362 is placed to be close to the third sidewall 327 crossing the bottom 322 and the second sidewall 326 on the second sidewall 326. The contact terminal member 362, as described above, is placed at the position corresponding to the partitioning wall 333 near the third sidewall 327. The centerline (the dotted and dashed line) of the position corresponding to the partitioning wall 333 is located within the range of the width W2 (the distance between the 2 broken line) of the contact terminal member 362 of the memory 360. In addition, in the ink cartridge 310 according to the embodiment of the present invention, the centerline of the contact terminal member 362 is at the nearly same position as the centerline corresponding to the partitioning wall 333.

The ink cartridge 310, like the ink cartridge 210, has a positioning rib 382, which protrudes from the second sidewall 326 and is extended towards the bottom 322. The positioning rib 382 is located out of the range of the width W2 of the contact terminal member 362. That is, the centerline (the dashed and dotted line) of the positioning rib 382 is in the outside of the width W2 of the contact terminal member 362.

The ink cartridge 310, like the ink cartridge 210, further includes a projecting part 390 more closely placed to the top of the ink cartridge 310 than the contact terminal member 362 of the memory 360 and the positioning rib 382 is. The projecting part 390 has a surface 392, which protrudes above the positioning rib 382 and is nearly parallel to the second sidewall 326. That is, referring to FIG. 13B, the position (the broken line) of the surface 392 of the projecting part 390 is beyond either the position (the dotted and dashed line) of the positioning rib 382 or the position (the double-dotted and dashed line) of the contact terminal member 362.

The ink cartridge 310 further includes an inverse mounting preventing rib 329 placed on the fourth sidewall 328 opposite to the third sidewall 227 near the contact terminal member 329.

Figure 14:
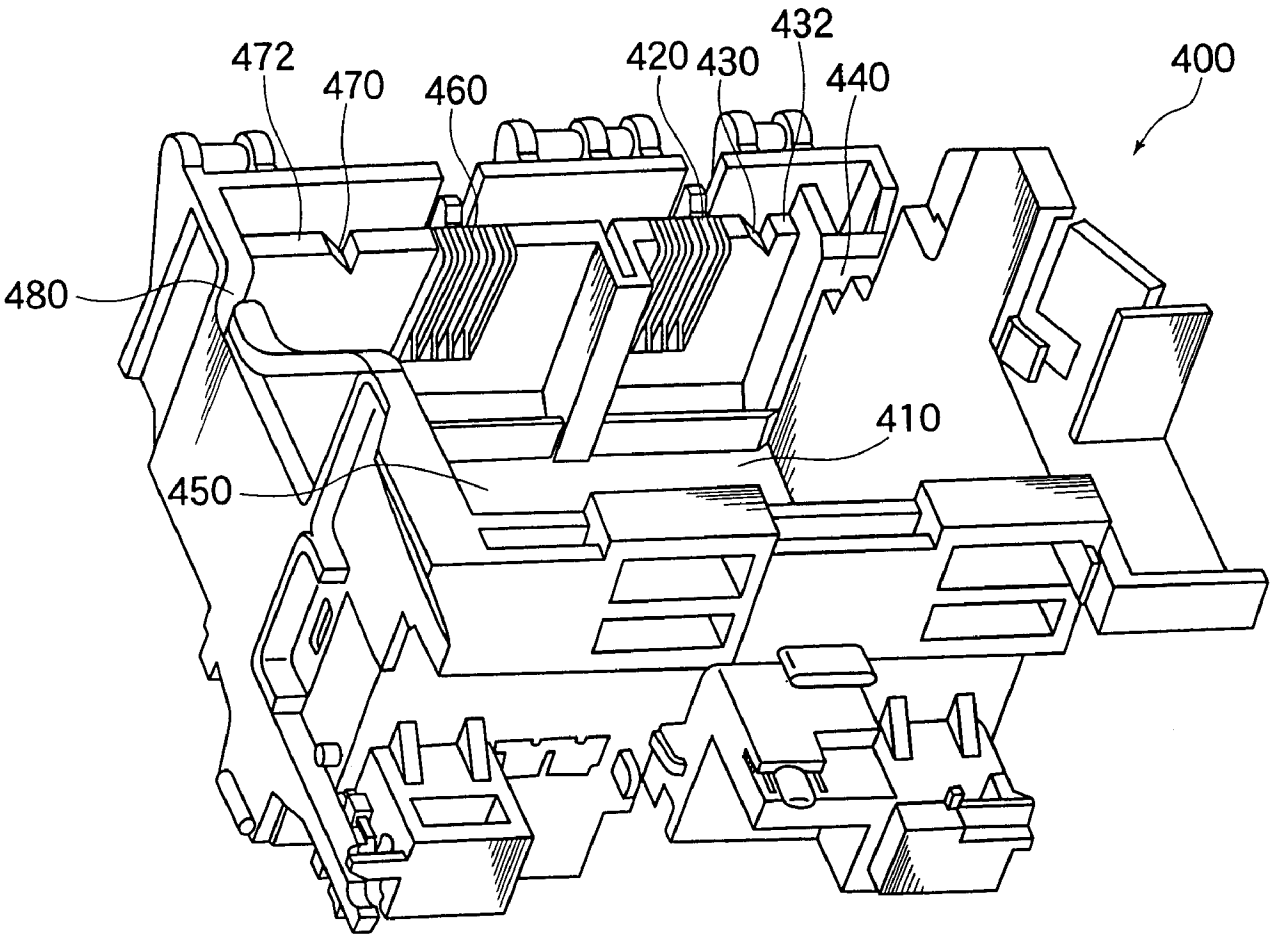
FIG. 14 is a perspective view of a carriage, in which two ink cartridges are installed.

FIG. 14 is a perspective view of a carriage, in which two ink cartridges are installed. The carriage 400 has the first cartridge holding section 410, in which the ink cartridge 210 containing black ink is installed and the second cartridge holding section 450, in which the ink cartridge 310 containing cyan, magenta and yellow ink is installed.

A contact terminal member 420 is placed at the position, which is in the first cartridge holding section 410 and corresponds to the contact terminal member 262 of the memory 260, when the ink cartridge 210 is installed in the first cartridge holding section 410. In addition, the first cartridge holding section 410 has a position decision groove 430, which is placed at the same sidewall as the contact terminal member 420 is on, is away from the second cartridge holding section 450 more than the contact terminal member 420 is and is engaged with the positioning rib 282 of the ink cartridge 210. Moreover, the first cartridge holding section 410 has a gap 440, which is placed at the sidewall opposite to the second cartridge holding section 450 and is engaged with the inverse mounting preventing rib 282 of the ink cartridge 210.

Though not shown in FIG. 14, an ink supply needle 412 is placed at the position, which is on the bottom of the first cartridge holding section 410 and corresponds to the ink supply section 240 of the ink cartridge. The ink supply needle 412 is hollow, and an end surface of the ink supply needle 412 is placed in the inside of the bottom of the carriage 400.

Like the first cartridge holding section 410, a contact terminal member 460 is placed at the position, which is in the second cartridge holding section 450 and corresponds to the contact terminal member 362 of the memory 360 when the ink cartridge 310 is installed in the second cartridge holding section 450. In addition, the second cartridge holding section 450 has an ink cartridge position regulating groove 470, which is placed at the same sidewall as the contact terminal member 460 is on, is away from the first cartridge holding section 410 more than the contact terminal member 450 is and is engaged with the positioning rib 382 of the ink cartridge 310. Moreover, the second cartridge holding section 450 has a gap 480, which is placed at the sidewall opposite to the first cartridge holding section 410 and is engaged with the inverse mounting preventing rib 382 of the ink cartridge 310. An ink supply needle 452, like the first cartridge holding section 410, is placed at the position, which is on the bottom of the first cartridge holding section 410 and corresponds to the ink supply section 240 of the ink cartridge. The construction of the ink supply needle 452 is similar to the that of the ink supply needle 412 of the first cartridge holding section 410, but since there are three ink supply openings 342, 344 and 346 of the ink cartridge 210, the ink supply needle 452 has three ink supply needles 452.

Figure 15:
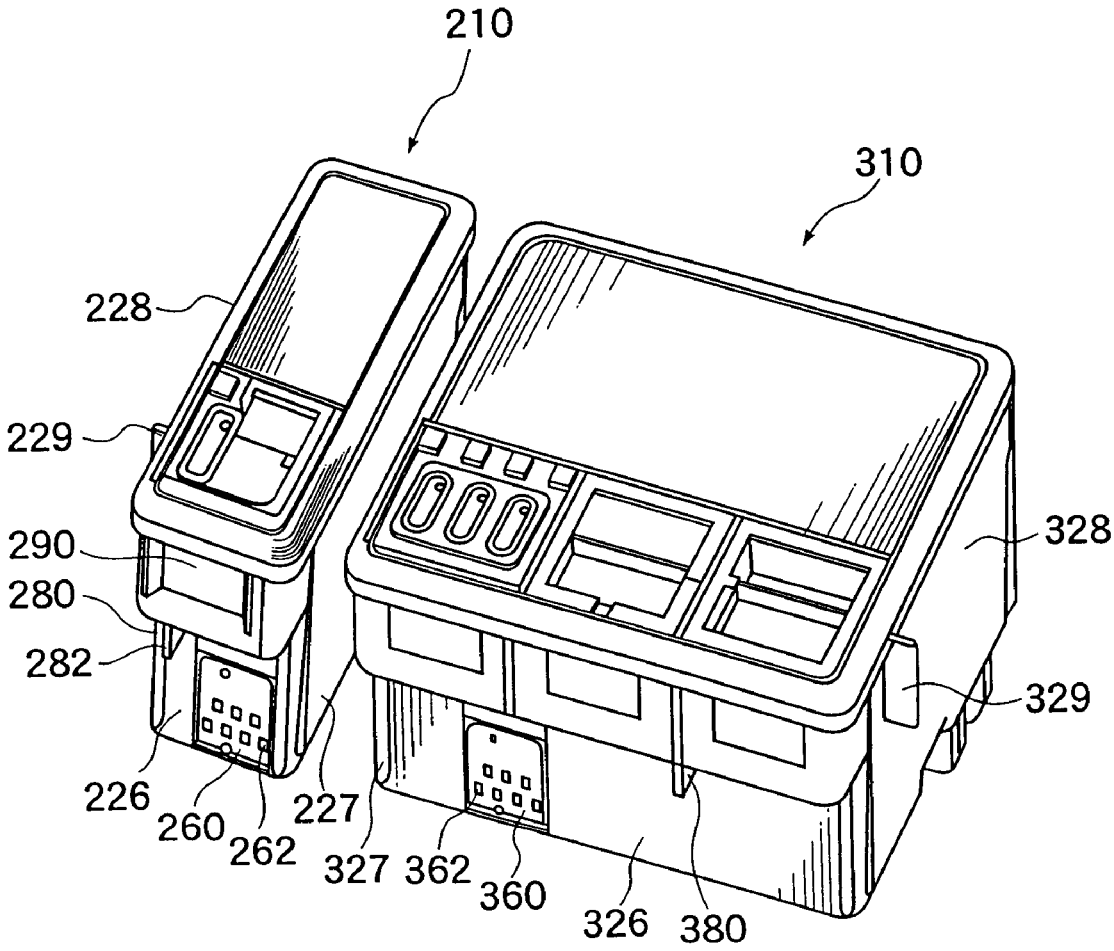
FIG. 15 is a perspective view showing the relation of the two ink cartridges installed in the carriage.

FIG. 15 is a perspective view showing the relation of the two ink cartridges installed in the carriage. As shown in FIG. 15, the ink cartridge 210 and the ink cartridge 310 are side-by-side installed in the carriage 400. In that case, the third sidewall 227 of the ink cartridge 210 and the third sidewall 327 of the ink cartridge 310 face each other.

As described above, the contact terminal member 262 of the ink cartridge 210 is placed to be close to the third sidewall 227, while the contact terminal member 362 of the ink cartridge 310 is placed to be close to the third sidewall 327. That is, the contact terminal member 262 of the ink cartridge 210 and the contact terminal member 362 of the ink cartridge 310 is positioned next to each other, while the 2 ink cartridge 210 and 310 are installed in the carriage 400. Accordingly, like the carriage 400 shown in FIG. 14, the contact terminal member 420 of the first cartridge holding section 410 and the contact terminal member 460 of the second cartridge holding section 450 can be closely placed each other so that wires of, for example, FPC do not need to be long.

In addition, as described above, the inverse mounting preventing rib 229 of the ink cartridge 210 is placed on the fourth sidewall 228 opposite to the third sidewall 227, while the inverse mounting preventing rib 329 of the ink cartridge 310 is placed on the fourth sidewall 328 opposite to the third sidewall 327. That is, the inverse mounting preventing rib 229 of the ink cartridge 210 and the inverse mounting preventing rib 329 of the ink cartridge 310 is not located facing each other. Consequently, the third sidewall 227 and the third sidewall 327 can be closely positioned so that the size of the whole carriage 400 can be small.

Figure 16A:
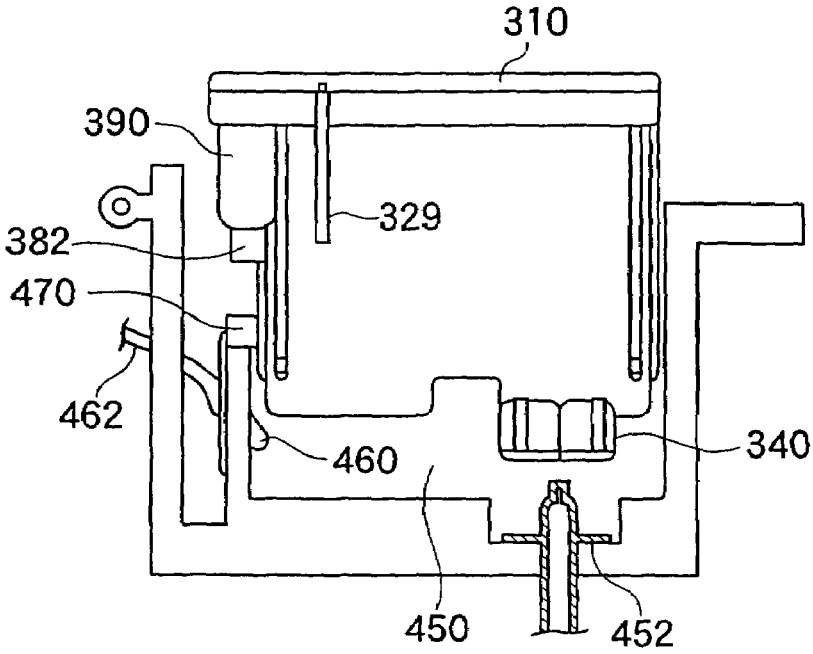
FIG. 16A and FIG. 16B are partly cross-sectional views showing that the ink cartridge is installed in the carriage.
Figure 16B:
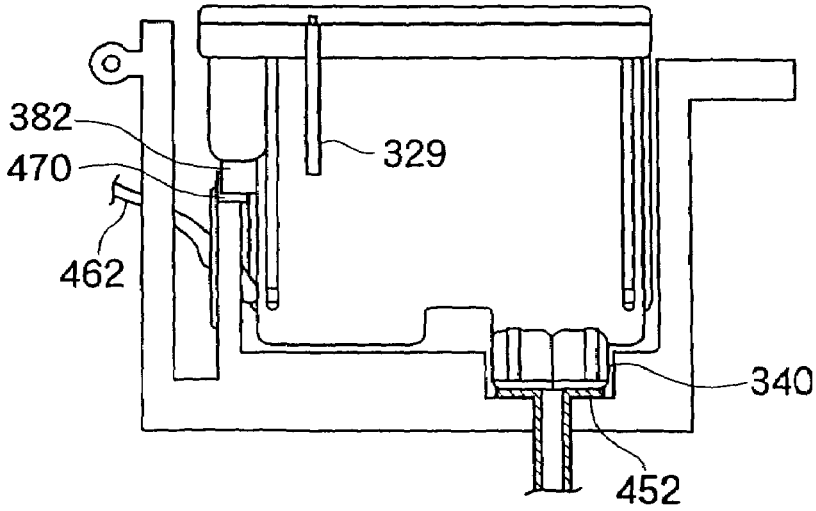

FIG. 16A and FIG. 16B are partly cross-sectional views showing that the ink cartridge 310 is installed in the carriage 400. FIG. 16A and FIG. 16B are cross-sectional views of the second cartridge holding section 450 of the carriage 400 with respect to a plane including the position regulating groove 470. Although it is described that the ink cartridge 310 is installed in the second cartridge holding section 450 of the carriage 400 as an example here, it is the same case that the ink cartridge 210 is installed in the first cartridge holding section 410 of the carriage 400.

As shown in FIG. 16A, the ink cartridge 310 is positioned in normal direction to the second cartridge holding section 420 of the carriage 400. Here, the normal direction means that the ink supply section 340 of the ink cartridge 310 faces the ink supply needle 452 of the second cartridge holding section 450 and the contact terminal member 362 of the ink cartridge 310 faces the contact terminal member 460 of the second cartridge holding section 450. The ink cartridge positioned in the normal direction is inserted into the second cartridge holding section 450 of the carriage 400.

As shown in FIG. 16B, the ink cartridge 310 being inserted, the positioning rib 382 is guided by the ink cartridge position regulating groove 470 of the second cartridge holding section 450. The inverse mounting preventing rib 329 is engaged with the gap 480 of the second cartridge holding section 450.

As the ink cartridge 310 is further inserted, the ink supply needle 452 of the second cartridge holding section 450 enters the inside of the ink supply section 340 of the ink cartridge 310. As the bottom of the ink supply section 340 of the ink cartridge 310 comes in contact with the end surface of the ink supply needle 452 of the second cartridge holding section 450, the installation of the ink cartridge 310 is over. Accordingly, the ink cartridge 310 supplies the printing apparatus with ink through the ink supply needle.

Figure 17A:
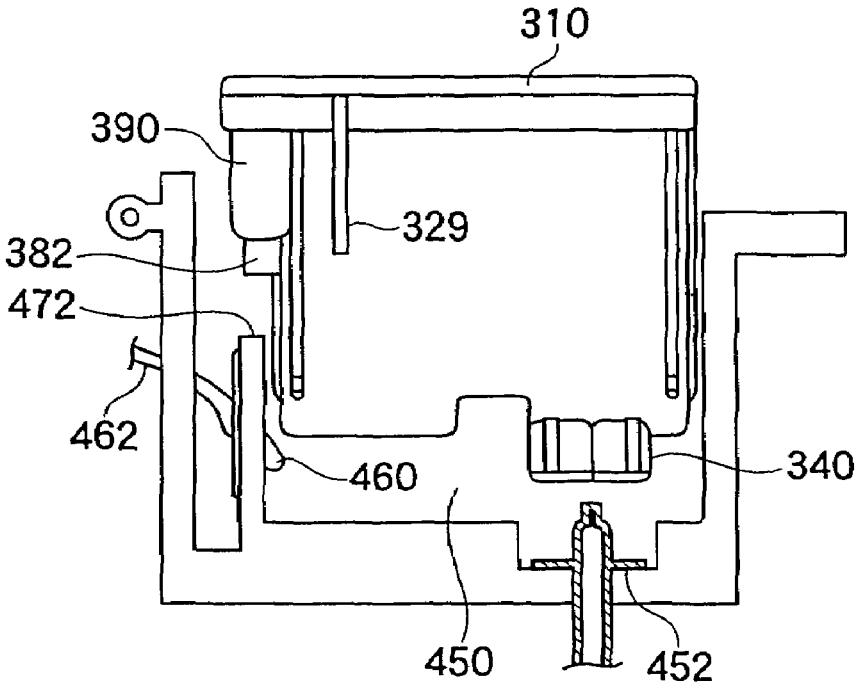
FIG. 17A and FIG. 17B are another partly cross-sectional views showing that the ink cartridge is installed in the carriage.
Figure 17B:
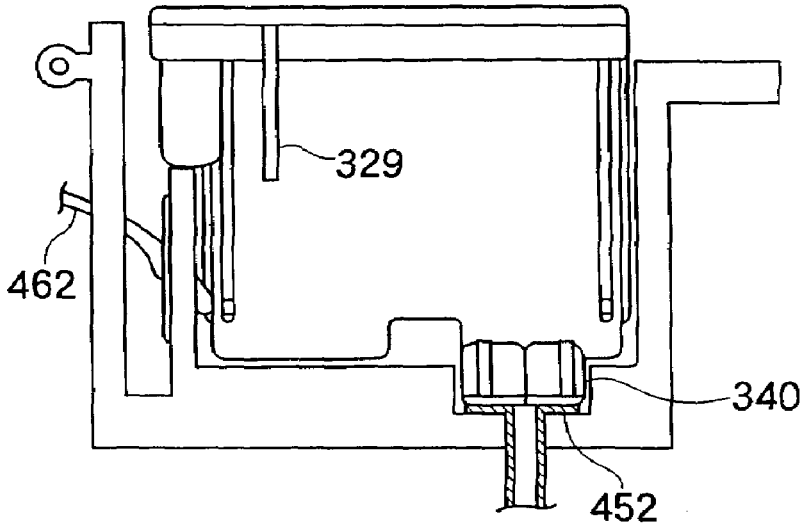

FIG. 17A and FIG. 17B are another partly cross-sectional views showing that the ink cartridge 310 is installed in the carriage 400. FIG. 17A and FIG. 17B are cross-sectional views of the second cartridge holding section 450 of the carriage 400 with respect to a plane not including the position regulating groove 470.

FIG. 17A, which corresponds to FIG. 16A, shows that ink cartridge 310 is positioned in the normal direction to the second cartridge holding section 420 of the carriage 400. FIG. 17B, which corresponds to FIG. 16B, shows a state of the ink cartridge 310 being installed in the second cartridge holding section 450 of the carriage 400.

As shown in FIG. 17B, when the bottom of the ink supply section 340 of the ink cartridge 310 comes in contact with the ink supply needle 452 of the second cartridge holding section, the lower surface of the projection part 390 of the ink cartridge 310 comes in contact with a surface 472 of the second cartridge holding section 450.

The position of the ink cartridge 310 is decided not only by the penetration of the ink supply needle 452 into the ink supply section 340, but also by the engagement of the positioning rib 382 and the ink cartridge position regulating groove 470. Accordingly, the contact terminal member 362 of the ink cartridge 310 is coupled to the contact terminal member 460 of the second cartridge holding section 450 with a degree of precision, even if the contact terminal member 362 of the ink cartridge 310 is positioned far away from the ink supply section 340, because the ink cartridge 310 is positioned in the direction to the same second sidewall 326 by the positioning rib 382. Consequently, the information obtained by the coupling of the contact terminal member 460 and the contact terminal member 262 of the ink cartridge 310 can be certainly transmitted to the printing apparatus through wires 462 of, for example, FPC.

It is possible to prevent the positioning rib 382 from damaging the contact terminal member 460 of the second cartridge holding section 450, when the ink cartridge 310 is installed in the second cartridge holding section 450, because the positioning rib 382 of the ink cartridge 310 is located in the outside of the width W2 of the contact terminal member 460.

Here, when the ink cartridge 210 is already installed, the ink cartridge 310 is positioned in the inverse direction. That is, it means that the ink cartridge is positioned as the first sidewall 324 faces the contact terminal member 460 of the second cartridge holding section 450 or the second sidewall 326 faces the ink supply needle 452. If the ink cartridge 310 is mounted in the second cartridge holding section 450 in this condition, the inverse mounting preventing rib 329 of the ink cartridge 310 will be blocked by the ink cartridge 210. Accordingly, the ink cartridge 310 will not be inserted any more. Consequently, the ink cartridge 310 is prevented from being installed in the second cartridge holding section 450 in the inverse direction.

According to the above embodiments of the present invention, the contact terminal member can be certainly coupled to the contact terminal member of the carriage, though the contact terminal member is placed far away from the ink supply section, because the ink cartridge is positioned in the direction to the same second sidewall by the positioning rib. Accordingly, the degree of freedom of the space where the contact terminal member of the ink cartridge is placed can be increased.

In addition, in the case that the contact terminal member is placed at the position corresponding to the partitioning wall of the ink cartridge, it is hard for the ink cartridge body to be transformed by the fabrication or the decrease of pressure in manufacturing the ink cartridge, and the contact terminal member can be further certainly coupled to the contact terminal member of the carriage.

Although the present invention has been described by way of exemplary embodiments, it should be understood that those skilled in the art might make many changes and substitutions without departing from the spirit and the scope of the present invention, which is defined only by the appended claims.

For example, though an ink-jet printer as a printing apparatus has been described by way of exemplary embodiments, the present invention can also be applied to such a facsimile apparatus or copying apparatus of ink-jet type, if these printing apparatuses include a carriage.

What is claimed is:

1. An ink cartridge detachably mountable on a printing apparatus, said printing apparatus having a print head and an ink supply needle supplying ink to the print head, comprising:

an ink body for containing ink therein which has a bottom wall, a first side wall adjacent to the bottom wall, a second side wall disposed opposite to the first side wall, a third side wall which intersects with the first and second side walls and a fourth side wall that is perpendicular to the second side wall and is opposite to the third side wall;

an ink supply section having an ink supply opening formed on the bottom wall at a position closer to the first side wall than the second side wall for allowing the ink supply needle to be inserted, the ink supply opening having a center axis;

a memory having a contact terminal member disposed on and facing outward from the second side wall, a centerline of the contact terminal member extending in a direction parallel to the center axis of the ink supply opening; and an inverse mounting preventing rib that is engageable with the carriage of the printing apparatus when the ink cartridge is installed in a proper orientation on the printing apparatus, and the inverse mounting preventing rib lies on the fourth side wall.

2. The ink cartridge as in claim 1, wherein the ink body has an upper wall disposed opposite to the bottom wall, comprising a projecting part provided near the upper wall above the contact terminal member.

3. The ink cartridge as in claim 2, wherein the projecting part comprises a surface which protrudes toward outside and extends beyond the contact terminal member, and at least a portion of the surface lies in a plane which is substantially parallel to the first side wall.

4. The ink cartridge as in claim 1, further comprising a plurality of ink chambers respectively defined by a plurality of partition walls that divide an interior of the ink body.

5. An ink cartridge pair comprising: a first ink cartridge and a second ink cartridge for providing a printing apparatus with ink via an ink supply port that communicates with a printing head when the first and second ink cartridges are mounted on the printing apparatus, each said ink cartridge including an ink body for containing ink therein and having a bottom wall, a first side wall that is adjacent to the bottom wall, a second side wall that is opposite to the first side wall, and a third side wall that is adjacent to both the bottom wall and the first side wall, an ink supply section having an ink supply opening that is located on the bottom wall at a position near to the first side wall and formed so as to receive the ink supply needle, and a memory having a contact terminal member located on the ink body near a third side wall, wherein, looking toward the front surfaces of the first and second ink cartridges, the third wall of the first ink cartridge is located on the right side of the first ink cartridge and the third side wall of the second ink cartridge is located on the left side of the second ink cartridge.

6. The ink cartridge pair as in claim 5, wherein one of the first and second ink cartridges has three ink chambers formed therein.

7. The ink cartridge pair as in claim 5, wherein the contact terminal members of the first and second ink cartridges are located adjacent to each other.

8. The ink cartridge pair as in claim 5, wherein the first and second ink cartridges each further comprise an inverse mounting preventing rib that is engageable with the carriage of the printing apparatus when each said ink cartridge is installed in a proper orientation on the printing apparatus, and the mounting prevention ribs of the ink cartridges lie in the same plane.

9. The ink cartridge pair as in claim 5, wherein both the third side walls of the first and second ink cartridges are arranged to be adjacent to each other and face together.

* * * * *